United States Patent [19]

Lehmann

[11] 4,162,116

[45] Jul. 24, 1979

[54] DETACHABLE, WATER-TIGHT CONNECTION ELEMENTS FOR DETONATING DEVICES AND COMPONENTS WHICH PROCESS FOR THE IGNITION SIGNAL

[75] Inventor: Kurt Lehmann, Sythen near Haltern, Fed. Rep. of Germany

[73] Assignee: Wasagchemie GmbH, Munich, Fed. Rep. of Germany

[21] Appl. No.: 899,897

[22] Filed: Apr. 26, 1978

Related U.S. Application Data

[63] Continuation of Ser. No. 533,517, Dec. 17, 1974, abandoned.

[30] Foreign Application Priority Data

Jul. 29, 1974 [DE] Fed. Rep. of Germany ..... 2436534

[51] Int. Cl.[2] ..... H01R 13/52

[52] U.S. Cl. ..... 339/60 M; 339/94 M; 339/274

[58] Field of Search ..... 339/60, 61, 75, 94, 339/274

[56] References Cited

U.S. PATENT DOCUMENTS

| | | | |
|---|---|---|---|
| 1,766,594 | 6/1930 | Buchli | 339/75 R |
| 2,486,195 | 10/1949 | Munsey | 339/61 M |
| 2,567,727 | 9/1951 | Quackenbush | 339/94 R |
| 2,619,515 | 11/1952 | Doane | 339/94 R |
| 2,698,926 | 1/1955 | Young | 339/94 M |
| 2,801,394 | 7/1957 | Derner et al. | 339/75 R |
| 3,345,604 | 10/1967 | Henschen et al. | 339/75 M |
| 3,487,353 | 12/1969 | Massa | 339/94 R |
| 3,594,696 | 7/1971 | Mitek, Jr. | 339/60 M |

FOREIGN PATENT DOCUMENTS

| | | | |
|---|---|---|---|
| 11167 | of 1906 | United Kingdom | 339/94 R |
| 1194353 | 6/1970 | United Kingdom | 339/61 M |

*Primary Examiner*—Joseph H. McGlynn
*Attorney, Agent, or Firm*—Hammond & Littell

[57] ABSTRACT

The invention relates to detachable, water-tight connecting elements adapted to produce water-tight electrical and mechanical connections primarily in detonating devices connectable under water comprising a coulping part having at least one contact pin mounted thereon, said at least one contact pin being in electrical contact with a sealed leadin wire, and at least one closed sealing bead disposed around aid at least one contact pin of a pliable electrically-insulating material adapted to form a closed sealing surface with an adjacent surface when under pressure; as well as the connected elements comprising a surface containing at least one contact pin, said connecting element and means to apply pressure to said connecting element whereby the contact pins are in contact with a water-tight seal around them.

6 Claims, 14 Drawing Figures

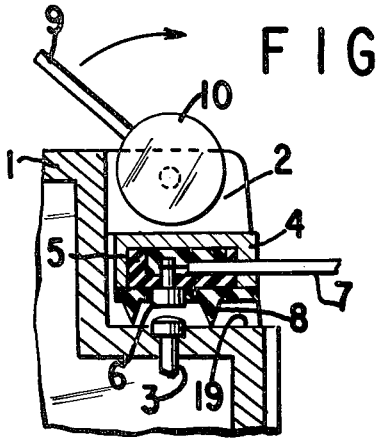
FIG. 1
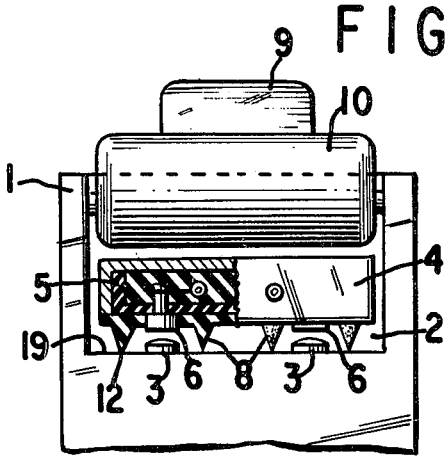
FIG. 2
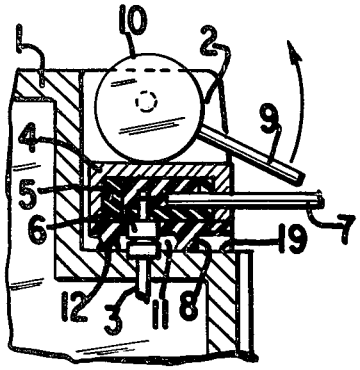
FIG. 3
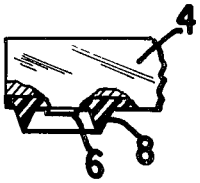
FIG. 4a
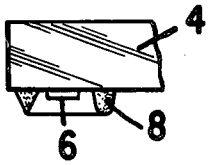
FIG. 4e
FIG. 4b
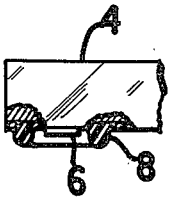
FIG. 4c
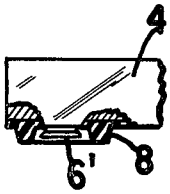
FIG. 4d
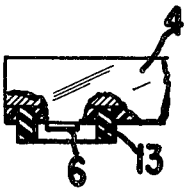

DETACHABLE, WATER-TIGHT CONNECTION ELEMENTS FOR DETONATING DEVICES AND COMPONENTS WHICH PROCESS FOR THE IGNITION SIGNAL

PRIOR APPLICATION

This is a continuation of Ser. No. 533,517, filed Dec. 17, 1974, and now abandoned.

THE PRIOR ART

Until now, detonating lines for underwater work have been connected to each other or to the fuse wires of electric spark igniters so that before being lowered below the water surface the individual wires of the detonating lines or fuse wires, twisted together, were covered with electrical insulating tape or another of the usual self-welding or cold-welding materials. In the case of shallower water depth, the twisted wires were protected against water and hence against shunts by capping them with plastic insulating caps filled with insulating compound. In the past, this practice has often resulted in malfunctions when underwater blasting was performed.

There has hardly been a necessity so far for a water-tight connection between the detonating line and the electric detonator because, even if the blast took place under water, the electric detonator required for the detonation was actuated above water. But due to the advance of technology, other work such as flame cutting for the removal of ship wrecks settled below the water level has been introduced in addition to underwater blasting. For this and many other applications feasible today, the use of an electric impulse generator, called a "detonating machine" in the following is an absolute necessity.

These new applications and the associated equipment require that it be possible for the above-mentioned connections between the components processing the electric signal, such as the fuses, the lead wires (fuse wires) to the detonating lines and the connections between the detonating lines and the detonating machine to be expediently made under water by divers even under the resultant, more difficult conditions. Such difficult conditions include the wearing of gloves by the diver, poor visibility and the use of the connecting elements in salt water.

OBJECTS OF THE INVENTION

It is the object of the invention to provide a connecting possibility for all the applications enumerated which satisfies all technical requirements.

Another object of the invention is the development of detachable, water-tight connecting elements adapted to produce water-tight electrical and mechanical connections primarily in detonating devices connectable under water comprising a coupling part having at least one contact pin mounted thereon, said at least one contact pin being in electrical contact with a sealed leading wire, and at least one closed sealing bead disposed around said at least one contact pin of a pliable electrically-insulating material adapted to form a closed sealing surface with an adjacent surface when under pressure.

These and other objects of the invention will become more apparent as the description thereof proceeds.

THE DRAWINGS

FIGS. 1 to 3 depict in various views, one embodiment of the coupling part of the invention.

FIGS. 4*a* to 4*e* depict various shapes of the sealing beads.

DESCRIPTION OF THE INVENTION

Figure 5:
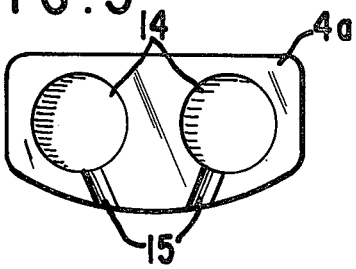
FIGS. 5 to 7 depict another embodiment of the coupling part of the invention.

The problem is solved in that the connecting elements required have a special shape and present sealing beads of a soft, pliable electrically-insulating material, which sealing beads, when subjected to pressure in mounting, form closed sealing surfaces due to their shape. According to the invention, an electrical and mechanical connection, water-tight and connectable under water, is assured between the individual sections of the detonating line, between the detonating line and the fuse wires of electric spark igniters, between the various fuse wires and between the detonating line and the detonating machine by a coupling part whose closed sealing beads, disposed around each contact pin, consist of a soft, pliable, electrically-insulating material and form closed sealing surfaces when subjected to pressure.

More particularly, the invention involves detachable, water-tight electrical and mechanical connections primarily in detonating devices connectable under water comprising a coupling part having at least one contact pin mounted thereon, said at least one contact pin being in electrical contact with a sealed leadin wire, and at least one closed sealing bead disposed around said at least one contact pin of a pliable electrically-insulating material adapted to form a closed sealing surface with an adjacent surface when under pressure.

In addition, the invention involves a device to accomplish a water-tight electrical and mechanical connection comprising an electrical device having a rigid surface containing at least one contact, the above recited connecting elements and means in connection with said electrical device to apply pressure on said connecting elements whereby the contact pins are in contact and surrounded by a water-tight seal.

The soft, pliable electrically-insulating material employed for the sealing beads may be, for example, natural rubber, synthetic rubber, silicon rubber or other suitable plastics. According to preferred embodiments of the invention, the sealing beads are annular or ring-forming, although other forms may be employed. The cross-section or profile of the sealing beads is of any geometrical shape such as an equilateral triangle, a semicircle, a trapezoid or a combination thereof. According to another preferred embodiment, both the coupling part and the sealing beads are made of the same material. In further development of the invention, the individual conductors of the detonating lines and/or fuse wires have coupling elements molded around them and, together with a molded part, are assembled to form the coupling part.

Embodiment examples of the water-tight connecting elements according to the invention are shown schematically in the drawings and described below. The same are not to be considered as limitative of the invention in any respect.

FIGS. 1 to 3 show, by way of example, one embodiment of the water-tight connecting elements (coupling part) between detonating line and detonating machine.

FIGS. 4*a* to 4*e* show embodiment examples of the shape of the sealing beads.

Figure 6:
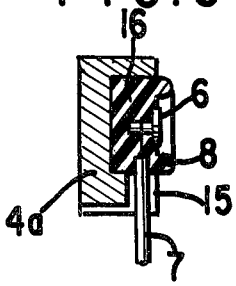
Figure 7:
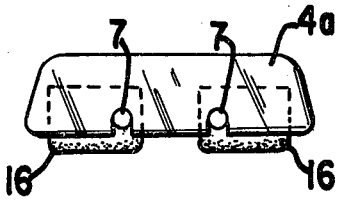

FIGS. 5 to 7 show another embodiment of the coupling part.

Figure 8:
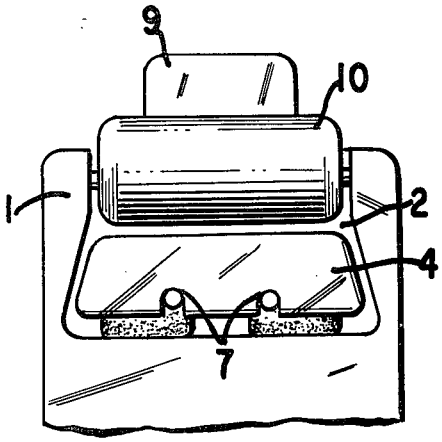
FIG. 8 depicts another embodiment of the water-tight connection between a detonating line and a detonating device employing the coupling part of FIGS. 5 to 7.

FIG. 8 shows an embodiment example of the water-tight connection between a detonating line (with coupling part according to FIGS. 5 to 7) and a detonating machine.

Figure 9:
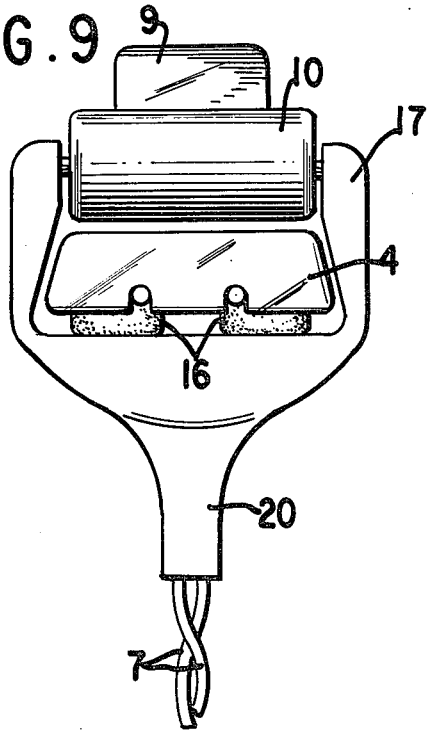
FIGS. 9 and 10 depict embodiments of the invention for coupling different components.

FIG. 9 shows an embodiment example of the water-tight connection between detonating lines.

Figure 10:
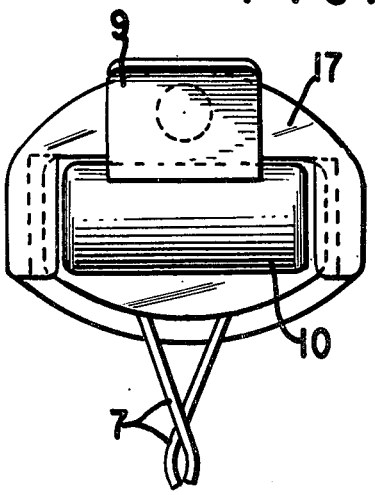

FIG. 10 shows an embodiment of the water-tight connection between fuse wires.

FIG. 1 is the sectioned side view and FIG. 2 the elevation of an example of the design of the coupling part of the detonating line and of the recess in the detonating machine housing to receive the coupling part, including an eccentric roller, disposed in the upper part of the recess for the retention of and the exertion of pressure on the coupling part, after the insertion of the coupling part into the recess in the detonating machine housing.

Located in the detonating machine housing 1 is a recess 2, the bottom of which contains the contacts 3, from which to take the electric ignition pulse. For the sake of simplicity, the detonating machine housing in the embodiment example is assumed to be plastic so that an insulated lead-in for the two contacts is obviated. The coupling part 4 contains a molded part 5 which supports the contact pins 6, to each of which one of the two conductors 7 of the detonating line is attached mechanically. The molded part 5, including the detonating line conductors 7 which may be soldered to the contact pins 6, has molded around it a soft plastic, and that in such a manner that the sunk-in contact pins 6 are each framed by a closed, such as annular, raised sealing bead 8.

The electric connector shown here has two poles, but may also have multiple poles, i.e., comprise more than two poles; correspondingly, more than two contact pins 6 and more than two contacts 3 are then provided; the same applies to the number of sealing beads 8.

After the insertion of the coupling part 4 into the recess 2 of the detonating machine housing 1, the lever 9 of the eccentric roller 10 is actuated in arrow direction (FIG. 1). This deforms the annular, raised sealing beads 8. FIG. 3 shows a sectional side view with the sealing beads in the deformed position and a metallic connection between the contact pins 6 in the coupling part 4 and the contacts 3 in the detonating machine housing is established. Under the pressure exerted by the actuation of the eccentric roller 10, the annular sealing beads 8 are deformed, and the circular sealing surface 12 is established making full contact with the surface 19 from which contacts 3 extend. The water still contained in the free space 11 at the start of the actuation of the eccentric roller 10 is partly squeezed out. The remaining part of the water is pressurized.

Due to the predetermined shape of the circular sealing surfaces 12, a perfect separation of the water still present in the free space around the contact pins 6, from the water surrounding the coupling part or the detonating machine is accomplished in any event, as was proven by the measurements taken. When a free coupling part 4 with contact pins 6 that are 5 mm in diameter and 25 mm center distance apart, and with annular sealing beads 8 of 20 mm outside diameter and semicircular profile (r−1.5 mm) made of silicon rubber of a Shore hardness of 50, was immersed in a 10% salt solution, the resistance between the two contact pins 6 was approximately 100 ohms. After establishment of the connection by means of the connecting elements according to the invention and after the formation of the circular sealing surfaces 12 making full contact across a 2.5 mm annular width, the same resistance values rose towards 400 k-ohms, even when both detonating line conductors were connected parallel to the surrounding water. The readings were taken under pressure conditions corresponding to the respective water depths up to 70 m. Even then, the resistance values were still 170 k-ohms, i.e., the resistance value of each ignition circuit is below that of a shunt circuit caused by the more or less conductive water by several decimal powers, 300 ohms being assumed as the maximum ignition circuit resistance. Higher resistance values are achievable by varying the dimensions and the material of the sealing beads (enlargement of the sealing surface) and/or increasing the contact pressure.

Shown in FIGS. 4a and 4c are several, but not exhaustive designs of the sealing bead profiles. For simplicity's sake, the sealing beads are again assumed to be annular, although any closed line, be it a triangle, rectangle or trapezoid, may form the basis of a sealing bead design.

FIG. 4*a* shows, as already shown in FIGS. 1 and 2, a profile of the sealing bead 8 in the shape of an equilateral triangle, FIG. 4*b* shows a profile of the sealing bead 8 in the shape of a semicircle and FIG. 4*c* in trapezoidal form.

One of the above mentioned design possibilities for the sealing beads is also optimally applicable to the sealing surface 19 on the detonating machine housing. It may be expedient, for instance, to design the profiles of the sealing beads 8 of the coupling part 4 (FIG. 4*a*) in the form of equilateral triangles and to provide annular indentions on the sealing surface 19 at the bottom of recess 2 in the detonating machine housing 1, around the contacts 3, of the same dimensions as those of the sealing beads 8 in FIG. 4*a*. While the connection is being made, the flanks of the sealing beads are pressed against the flanks of the perforations, thereby increasing the sealing area. This design is not shown in the drawings.

FIG. 4*d* shows an embodiment in which either contact pins 6 which, including the already metallically connected conductors 7 of fuse wires, are embedded in a hard plastic 5 for safety and economy reasons, but in which the annular sealing beads 8 around either contact pins 6 are replaced by two likewise annular grooves in the coupling part 4, into which grooves are inserted deformable soft plastic rings 13 as sealing beads whose profile may also be of various designs.

To improve the metallic contact between the contacts 3 disposed in the detonating machine housing and the contact pins 6 in the coupling part 4, the contact pins 6 or the contacts 3 are designed in the form of spring contacts. A spring contact pin 6' is shown in FIG. 4c.

As will be described in the following by way of example, the coupling part 4 may be especially designed so that the detonating line conductors can be laid separately. A hard plastic molding 4*a* (FIG. 5*a*) contains two cylindrical recesses 14 and two slots 15 extending outward from them. As FIG. 6 shows, the contact pin 6 is mounted in a cylinder of soft plastic 16 and metallically connected to each conductor 7 and a soft plastic of cylindrical shape molded around it. These cylindrical coupling elements 16 can be inserted, pressed or cemented into the cylindrical recesses 14 of the molded part 4*a* of FIG. 5, with the conductors 7 finding room in the slots 15. The design of the contact pin 6 and of the sealing bead 8 may be analogous to the design possibilities already described. In order to safely prevent the coupling part from being inserted into the recess wrongly, i.e., with the sides reversed, the coupling part 4 and the recess 2 fitting the coupling part on the detonating machine present, in further development of the invention, for the prevention of side-reversed isertion, an appropriately keyed shape, such as beveled narrow sides, as shown in FIGS. 7 and 8.

FIGS. 9 and 10 show, in elevation and top view, respectively, an embodiment example for a possibility of interconnecting detonating lines or for connecting detonating lines to the fuse wires of electric fuses. A receptacle 17, looking similar to the connector parts of the detonating machine, contains, as already described, a recess for the insertion of the coupling part 4 and the eccentric roller 10 required for clamping. The receptacle 17 may consist of a hard plastic or of metal. It is of rounded, easy-to-grip shape and has a connecting nipple 20. The receptacle, too, may be molded to the conductors 7 of the detonating line or, if reusability is desired, it may be provided with a detachable connecting nipple 20. Making it water-tight may be accomplished, for example, by packings or by filling with a removable sealing compound such as silicon rubber.

In addition to the design shown in the drawings, the coupling part 4 may be of any other shape.

The element exerting the pressure, apart from the eccentric roller 10 with lever 9 as shown in the drawings, may be realized in the form of other means such as a screw or a cap nut.

The preceding specific embodiments are illustrative of the practice of the invention. It is to be understood, however, that other expedients known to those skilled in the art or disclosed herein may be employed without departing from the spirit of the invention or the scope of the appended claims.

I claim:

1. A device to accomplish a water-tight electrical and mechanical connection between contacts in detonating devices connectable under water by divers wearing gloves comprising:

(a) an electrical device having a rigid surface containing at least two electrical contacts each terminating in a contact area, (b) at least one detachabie connecting element comprising a coupling part having at least two contact pins each terminating in a contact area mounted thereon, each of said contact pins being in electrical contact with a sealed leadin wire, and a closed sealing bead disposed around but offset from each of said contact pins of a pliable electrically-insulatng material adapted to form a closed sealing surface with an adjacent surface when under pressure, each of said closed sealing beads when not under pressure being of sufficient extension whereby when said contact areas of said at least two contact pins and said at least two electrical contacts are abutting, each of said closed sealing beads is compressed by said rigid surface of said electrical device, and (c) means in connection with said electrical device to apply pressure on said at least one detachable connecting element comprising an eccentric roller with a lever fixed to said roller whereby each of the said contact pins each terminating in a contact area is in electrical and mechanical contact with and abuts the contact area of each of said electrical contacts and said sealing beads are deformed against said rigid surface forming a water-tight seal on application of said pressure.

2. The device of claim 1 wherein said sealing bead in said connecting element is annular in form.

3. The device of claim 1 wherein the cross-sectional profile of said sealing bead in said connecting element is of a geometrical shape selected from the group consisting of a triangle, a semicircle, a rectangle, a trapezoid and combinations thereof.

4. The device of claim 1 wherein said at least one contact pin is a spring contact terminating in a contact area.

5. The device of claim 1 wherein said contact pin being in electrical contact with a sealed leadin wire is individually mounted in a sealed receptacle with said closed sealing bead and is adapted to be frictionally attached to said coupling part.

6. The device of claim 1 wherein said electrical device (a) and said at least one detachable connecting element (b) having cooperating keying means whereby only one method of contacting the two by pressure is possible.

* * * * *